US011118800B2

(12) United States Patent
McArdle

(10) Patent No.: US 11,118,800 B2
(45) Date of Patent: Sep. 14, 2021

(54) DUCT POSITIONED WICKING EVAPORATIVE HUMIDIFIER

(71) Applicant: Ademco Inc., Golden Valley, MN (US)

(72) Inventor: Ryan McArdle, Saint Louis Park, MN (US)

(73) Assignee: Ademco Inc., Golden Valley, MN (US)

( * ) Notice: Subject to any disclaimer, the term of this patent is extended or adjusted under 35 U.S.C. 154(b) by 163 days.

(21) Appl. No.: 16/570,854

(22) Filed: Sep. 13, 2019

(65) Prior Publication Data

US 2021/0080129 A1 Mar. 18, 2021

(51) Int. Cl.

| | |
|---|---|
| ***F24F 3/14*** | (2006.01) |
| ***B01F 3/04*** | (2006.01) |
| ***F24F 6/04*** | (2006.01) |
| *F24F 6/00* | (2006.01) |

(52) U.S. Cl.

CPC ..... *F24F 3/14* (2013.01); *B01F 3/04085* (2013.01); *F24F 6/043* (2013.01); *F24F 2006/008* (2013.01)

(58) Field of Classification Search

CPC ..... F24F 3/14; F24F 6/00; F24F 6/043; B01F 3/04; B01F 3/04085

See application file for complete search history.

(56) References Cited

U.S. PATENT DOCUMENTS 3,491,746 A * 1/1970 Harris ..... F24F 6/04 126/113
5,853,625 A 12/1998 Kensok et al.
6,161,540 A 12/2000 Fecteau
6,588,734 B2 * 7/2003 Redner ..... F23L 13/00 126/113
8,640,704 B2 2/2014 Spoo et al.
2013/0106004 A1 5/2013 Stumphauzer

FOREIGN PATENT DOCUMENTS

EP 1258267 B2 7/2013
WO 2004028660 A1 4/2004

OTHER PUBLICATIONS

Aburub et al., "Experimental Investigations of a Cross-Flow Humidification Dehumidification Desalination System," International Water Technology Journal, vol. 7, No. 3, Sep. 2017, 12 pp.
Chandler, "Explained: Hydrophobic and hydrophilic," MIT News, Jul. 16, 2013, accessed from http://news.mit.edu/2013/hydrophobic-and-hydrophilic-explained-0716, 3 pp.

* cited by examiner

*Primary Examiner* — Robert A Hopkins
(74) *Attorney, Agent, or Firm* — Shumaker & Sieffert, P.A.

(57) ABSTRACT

A wicking evaporative humidifier in which cartridge that includes a pad is inserted directly into an air flow through the wall of a duct that distributes conditioned air throughout a structure. A portion of the cartridge may be inserted into a tray filled with water, which may use capillary forces to wick water through the cartridge to the area of the cartridge that is inserted through the duct and within the air flow. Air passing through duct and through and around the cartridge pad evaporates the moisture wicked into the pad and distributes the moisture throughout the structure.

19 Claims, 7 Drawing Sheets

DUCT POSITIONED WICKING EVAPORATIVE HUMIDIFIER

TECHNICAL FIELD

The disclosure relates to heating, ventilation, and air conditioning (HVAC) humidifier systems.

BACKGROUND

Some forced air heating ventilation and air conditioning systems (HVAC) may include a humidifier appliance to add moisture to the air. Some example humidifier appliances may include steam injection, water atomization, and evaporative humidifiers. A bypass type evaporative humidifier may direct air from an air stream of an HVAC system, through a moistened humidifier pad, and back into an air stream of the HVAC system. Such humidifiers often include a housing mounted to the outside of an air duct, plenum or the like of the HVAC system. The housing may include an internal cavity that houses the humidifier pad, an air inlet that directs an incoming air stream from the HVAC system to the humidifier pad, and an air outlet that directs a moistened air stream from the humidifier pad and into an air stream of the HVAC system. In some humidifiers, a powered fan is provided to help force air from the air inlet to the air outlet and through the humidifier pad. In other humidifiers, a pressure differential created by the main circulating fan or blower of the HVAC system between the return air duct and the supply air duct is used to draw air from the supply air duct, through the humidifier pad of the humidifier, and to the return duct of the HVAC system.

SUMMARY

In general, the disclosure is directed to a wicking evaporative humidifier in which cartridge that includes a pad or absorbing material is inserted directly into an air flow that is distributed throughout a structure. In some examples a portion of the cartridge may be inserted through the wall of a duct carrying the air flow. Another portion of the cartridge may be inserted into a tray filled with water, which would include a wicking pad that may absorb water from tray. The portion of the cartridge inserted into the water tray may take advantage of capillary forces to wick water through the cartridge to the area of the cartridge that is inserted through the duct and within the air flow."

Air passing through the cartridge pad evaporates the moisture wicked into the pad and distributes the moisture throughout the structure. In some examples the water tray may be supplied by a valve controlled by a water level sensor. The valve may be further controlled by other circuitry that allows the water valve to supply water to the water tray and cartridge when humidity needs to be increased within the structure. When the circuitry determines that humidity is at a sufficient level, the circuitry may prevent the valve from supplying water to the cartridge.

In one example, the disclosure is directed to a device comprising: a cartridge comprising a first portion and a second portion, wherein: the first portion is configured to absorb liquid water and wick the liquid water to the second portion; the second portion is configured to: be positioned in an air stream of a forced air heating ventilation and air conditioning (HVAC) system such that at least a portion of the air stream passes through the second portion of the cartridge, received and distribute the liquid water from the first portion by capillary action. allow the liquid water to evaporate from the second portion and be carried by the air stream away from the cartridge. a reservoir configured to: be mechanically attached to an outside surface of a wall of a duct containing the air stream of the HVAC system; hold a volume of liquid water; receive the first portion of the cartridge such that the first portion is maintained in contact with the liquid water. The details of one or more examples of the disclosure are set forth in the accompanying drawings and the description below. Other features, objects, and advantages of the disclosure will be apparent from the description and drawings, and from the claims.

In another example, the disclosure is directed to a system comprising: a heating, ventilation and air conditioning (HVAC) duct configured to convey air to an inside space of a structure; wherein the HVAC duct is arranged between an output of a circulation blower and a register configured to deliver an air stream from the circulation blower to the inside space of the structure, wherein the HVAC duct comprises a slot, wherein the slot is arranged at a position in the HVAC duct in which the air stream is conveyed in a substantially vertical direction, and the slot is arranged such that a horizontal dimension of the slot is larger than a vertical dimension of the slot; a liquid reservoir attached to the HVAC duct parallel to the horizontal dimension of the slot; and a pad inserted into the slot, such that a first portion of the pad extends across an interior cross-section of the HVAC duct and wherein: at least a portion of the air stream from the circulation blower passes through the first portion of the pad, and a second portion of the pad is inserted into the liquid reservoir such that the second portion of the pad is configured to wick a liquid from the liquid reservoir to the first portion of the pad.

DETAILED DESCRIPTION

Figure 1:
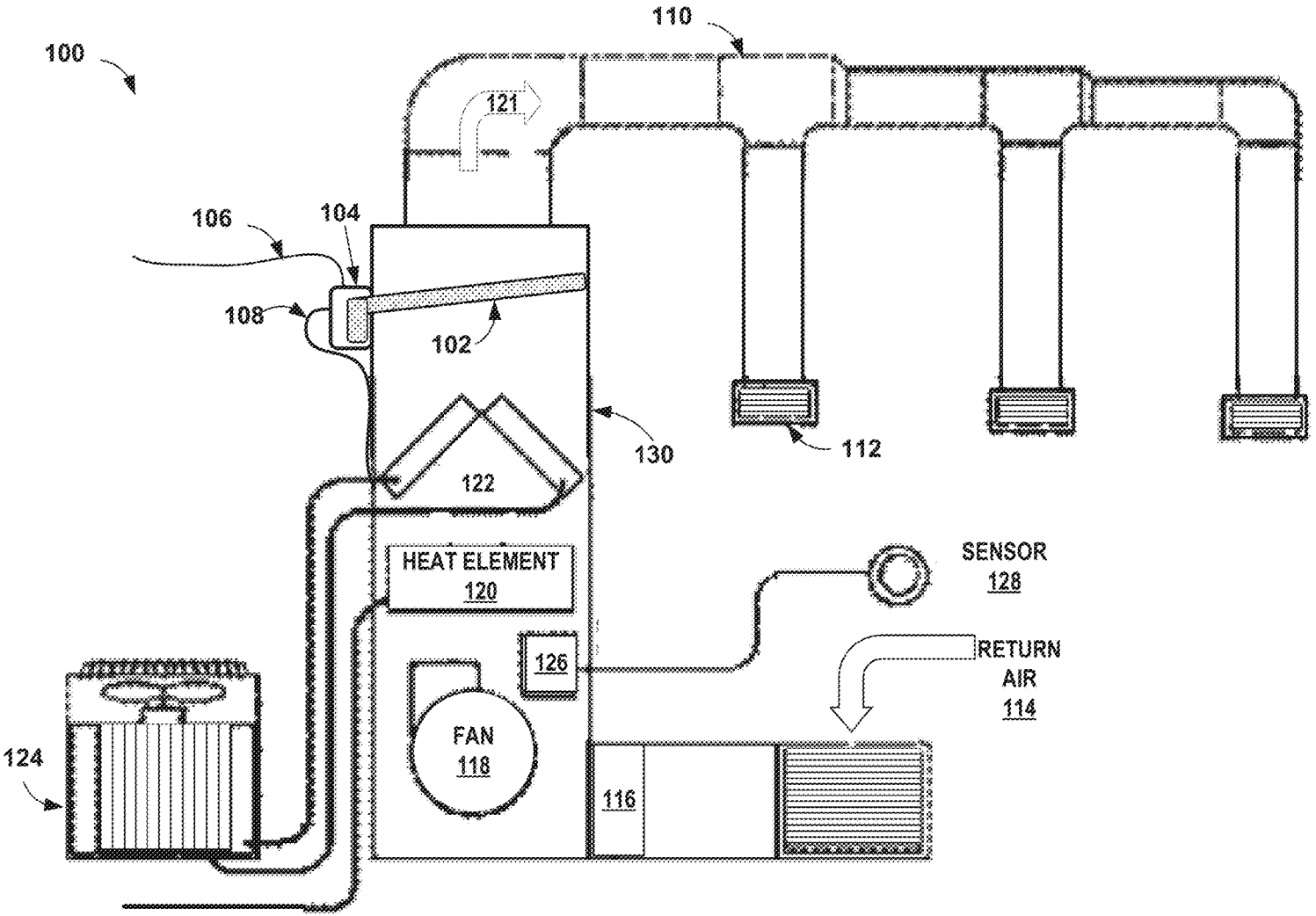
FIG. 1 is a conceptual diagram illustrating an example wicking evaporative humidifier installed in an HVAC system according to one or more techniques of this disclosure.

FIG. 1 is a conceptual diagram illustrating an example wicking evaporative humidifier installed in an HVAC system according to one or more techniques of this disclosure. The example of system 100 is one possible arrangement for a forced air HVAC system. In other examples, system 100 may include more or fewer components and a different arrangement of components.

The example of system 100 include heat exchanger housing 130 (housing 130 for short), distribution duct 110, return air duct 114, compressor assembly 124, filter 116, one or more sensors 128, one or more control units 126, and a wicking evaporative humidifier device including cartridge 102, overflow drain 108, water inlet 106 and tray 104. System 100 may be installed in a residential or commercial building to heat, cool, filter, remove humidity and circulate air within the building.

Housing 130 may include one or more heat exchangers such as A-type exchanger 122 and heat element 120 as well as fan 118. Housing 130 may include other components not shown in FIG. 1, such as an induction blower, pressure switches or sensors, humidity sensors and similar components. Housing 130 may direct an air stream 121 received from return air duct 114, through fan 118, the one or more heat exchangers and cartridge 102 to distribution duct 110.

Fan 118 receives an air stream 121 from an inside space of a building or other structure via return air duct 114 and filter 116. Fan 118 may also be referred to as a circulation blower to differentiate fan 118 from an induction blower. In some examples, air from outside the structure may also be directed to either or both of return air duct 114 and to the induction blower (not shown in FIG. 1). Fan 118 may pressurize air stream 121 such that air stream 121 is forced through the heat exchangers, cartridge 102 and through distribution duct 110.

Heat element 120 may be any of an electric heat element, a gas furnace, a heat exchanger as part of a heat pump, or any other type of heat exchanger. In the example of a heat pump, such as a geothermal heat pump, heat element 120 may be used to reduce the temperature of air stream 121 flowing through heat element 120, as well as to raise the temperature of air stream 121. Heat element 120 may receive electric power, in the example of a resistive electric heating element, or a combustible gas, such as propane or natural gas, in the example of a gas furnace.

A-type heat exchanger 122 may connect to compressor assembly 124. In some examples, compressor assembly 124 may be configured as a heat pump, while in other examples compressor assembly 124 may be configured as the outdoor portion of an air conditioning (A/C) unit. In the example of a heat pump, A-type heat exchanger 122 may either cool and remove moisture from air stream 121 or increase the temperature of air stream 121 as it passes through A-type heat exchanger 122. In the example of an A/C unit, A-type heat exchanger 122 may only reduce the temperature and condense moisture from air stream 121. In some examples housing 130 may include a drain tray and drain configured to capture moisture condensed from air stream 121 by A-type heat exchanger 122 and convey the liquid moisture outside of housing 130 (not shown in FIG. 1).

Compressor assembly 124 may include a blower or fan to draw air through a heat exchanger, which may be placed around the periphery of compressor assembly 124. Compressor assembly 124 may also include a motor to drive the fan, a compressor, one or more controllers, valves, sensors including temperature and pressure sensors and other components that may not be shown in FIG. 1.

Controller 126 may include one or more processors configured to receive signals from rooms within the inside space of the building, such as via one or more sensors 128. Controller 126 may also receive signals from sensors within system 100 such as furnace temperature, air stream humidity, pressure and temperature sensors, flame sensors, and similar sensors concerned with the safe and efficient operation of system 100. Controller 126 may also be configured to receive data from a network via a wired or wireless connection with information such as temperature, humidity and other weather conditions outside the building, commands to adjust the operation of system 100, and similar data.

Examples of a processor in controller 126 may include any one or more of a microcontroller (MCU), e.g. a computer on a single integrated circuit containing a processor core, memory, and programmable input/output peripherals, a microprocessor (μP), e.g. a central processing unit (CPU) on a single integrated circuit (IC), a controller, a digital signal processor (DSP), an application specific integrated circuit (ASIC), a field-programmable gate array (FPGA), a system on chip (SoC) or equivalent discrete or integrated logic circuitry. A processor may be integrated circuitry, i.e., integrated processing circuitry, and that the integrated processing circuitry may be realized as fixed hardware processing circuitry, programmable processing circuitry and/or a combination of both fixed and programmable processing circuitry.

Sensors 128 may include temperature sensors, humidity sensors, occupancy sensors and similar sensors that determine environmental conditions of a room in the building and provide information to controller 126 to configure and control the operation of system 100. In some examples sensors 128 may be operatively coupled to controller 126 and send signals to controller 126 with raw information such as the temperature of a room in the building. In other examples, sensors 128 may be configured as a thermostat or humidistat that sends signals to controller 126 to turn on or off the heating, air conditioning or ventilation functions of system 100.

Distribution duct 110 in the example of system 100 is an HVAC duct configured to convey air to an inside space of a structure. Distribution duct 110 may include an air handler, or air flow valves that may control to which registers 112 air stream 121 will flow (not shown in FIG. 1). Air flow valves may also be referred to as baffles or controllable registers in this disclosure. In some examples registers 112 may be controllable, e.g. manually or by controller 126 or some other controller, to restrict or allow air flow into a room.

Filter 116 may be configured to remove contaminants from air stream 121. Filter 116 may include a structural support layer and one or more other layers configured to remove dust, allergens and other particulates from air stream 121. In some examples 116 may be configured as an electrostatic filter.

HVAC system 100 may also include a wicking evaporative humidifier configured to provide moisture to air stream 121. The wicking evaporative humidifier in the example of system 100 is placed in a duct portion of housing 130 that is located between an output of fan 118 and register 112 and in which air stream 121 is conveyed in a substantially vertical direction. The duct may include a slot through which cartridge 102 extends into the duct, such that air stream 121 passes through and around cartridge 102. In the example of FIG. 1, the duct portion of housing 130 is depicted as a rectangular duct. In other examples the duct may be other shapes such as a round duct. The shape of cartridge 102 may be configured to conform to the shape of the duct into which cartridge 102 is placed.

In the example of system 100, the slot in the duct is arranged such that a horizontal dimension of the slot is larger than a vertical dimension of the slot. The wicking evaporative humidifier may also include a liquid reservoir, i.e. tray 104, which may be attached to the HVAC duct parallel to the horizontal dimension of the slot.

Water inlet 106 may be implemented as a piece of tubing connected to a water source and controlled by a valve (not shown in FIG. 1). The valve may be controlled to maintain predetermined water level in tray 104. The valve may also be controlled based on a humidity level in air stream 121 satisfying a predetermined humidity threshold. In some examples, the wicking evaporative humidifier may include a controller to operate the water valve as well as a water level sensor, such as a float valve or other type of sensor for tray 104 (not shown in FIG. 1). In other examples, a different controller, such as controller 126, may operate the water valve. In some examples, the water valve may be implemented as a solenoid water control valve.

In some examples, the wicking evaporative humidifier may include an overflow drain 108. Overflow drain 108 may be implemented as a tube or similar component that is configured to reduce the risk of water overflowing in tray 104 and entering housing 103.

Cartridge 102 may be implemented as a pad with one or more layers of a material that is configured to wick liquid, such as water, from tray 104 and distribute the liquid to other portions of cartridge 102. Cartridge 102 may include a portion of the pad inserted into the slot, such that the portion of the pad extends across an interior cross-section of the HVAC duct of housing 130. The portion of the pad that extends across the duct may be positioned such that at least a portion of the air stream 121 from fan 118 passes through this portion of the pad. The air passing through and around cartridge 102 may evaporate liquid in this portion of cartridge 102 such that air stream 121 carries the moisture to distribution duct 110 and to register 112 to be distributed to rooms within the building. Cartridge 102 may also be referred to as a humidifier pad, an absorption pad, a water distribution pad, and other similar terms in this disclosure.

Cartridge 102 may also include a second portion of the pad is inserted into the liquid reservoir such that the second portion of the pad is configured to wick liquid from the liquid reservoir to the first portion of the pad by capillary action.

In operation, a humidity sensor, or some other trigger, may cause the water valve to allow water to fill tray 104. In some examples, the water valve operation may be affected by an interlock that requires one or both of fan 118 to be operating as well as heat to be generated by one or more heat exchangers of system 100, such as heat element 120. Warm air passing through and around cartridge 102 may evaporate liquid within the pad portions of cartridge 102 more efficiently than cold air. Also, in some examples the water valve may source the liquid from the hot water heater because hot water may evaporate more efficiently than cold water.

The second portion of the pad of cartridge 102 may absorb water from tray 104 and wick the water to the first portion of the pad of cartridge 102, which extends into the duct of housing 103. The material of the pad of cartridge 102 may distribute the liquid water throughout the pad such that air stream 121 evaporates the liquid water and carries the moisture along to rooms within the structure.

Should the water level sensor indicate that the water level within tray 104 has reached a sufficient level, the water level sensor may cause the water valve to stop the water flow. Alternatively, the water level sensor may be implemented as a float valve that prevents water from flowing into tray 104 but does not turn off the water valve. When system 100 determines that the humidity has reached a desired level, that fan 118 has stopped running, or that the one or more heat exchangers has stopped producing heat, a controller may cause the water valve to stop the water flow.

The wicking evaporative humidifier of system 100 may include advantages over other types of humidifier units. In some examples, HVAC system 100 may need to be placed in a tight space, such as a utility closet of a building. The compact size of the wicking evaporative humidifier of this disclosure may be significantly smaller than other types of humidifiers, such as a bypass humidifier, fan-based humidifier or steam humidifier. The simplicity of the wicking evaporative humidifier may result in a lower material cost when compared to other types of humidifiers. Installation of the wicking evaporative humidifier of this disclosure may reduce labor required and also reduce the overall cost of the wicking evaporative humidifier of this disclosure. Other advantages include the collapsible cartridge and the small size once the product is packed. Since, the packaging size will be much smaller and more safely transferable, an installer may have more stock of this type of cartridge on their truck making them more readily available for sale to the end user. Other examples of humidifier cartridge may consume more volume when packaged and may be subject to damage, such as being crushed or bent by other objects during shipping.

Figure 2:
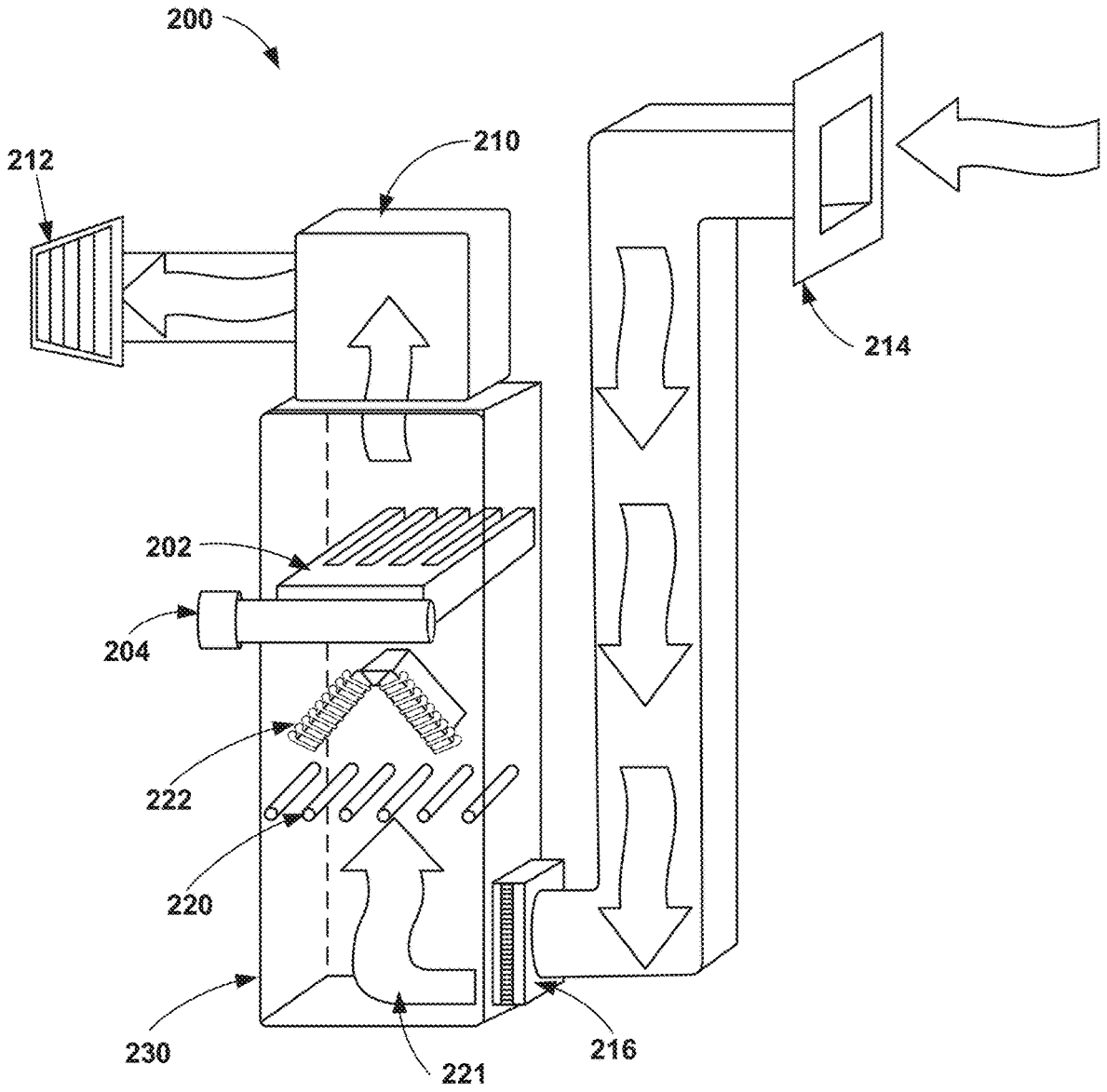
FIG. 2 is a conceptual diagram illustrating an example evaporative humidifier installed in the air flow of an HVAC system according to one or more techniques of this disclosure.

FIG. 2 is a conceptual diagram illustrating an example evaporative humidifier installed in the air flow of an HVAC system according to one or more techniques of this disclosure. Like system 100 described above in relation to FIG. 1, system 200 may be installed in a structure to provide heating, cooling and ventilation for the structure.

The example of system 200 depicted in FIG. 2 includes: housing 230 with air stream 221, distribution duct 210, return air duct 214, filter 216, A-type heat exchanger 222, heat element 220 and a wicking evaporative humidifier device including cartridge 202 and tray 204, which are, respectively, examples of housing 130 with air stream 121, distribution duct 110, return air duct 114, filter 116, A-type heat exchanger 122, heat element 120 and a wicking evaporative humidifier device including cartridge 102 and tray 104 described above in relation to FIG. 1. Unless otherwise described, the characteristics and functions of housing 230 with air stream 221, distribution duct 210, return air duct 214, filter 216, A-type heat exchanger 222, heat element 220 and a wicking evaporative humidifier device including cartridge 202 and tray 204, may be similar or the same as the characteristics and functions of, respectively, housing 130 with air stream 121, distribution duct 110, return air duct 114, filter 116, A-type heat exchanger 122, heat element 120 and a wicking evaporative humidifier device including cartridge 102 and tray 104 of FIG. 1.

As with system 100, wicking evaporative humidifier is positioned so that air stream 221 flows through and around cartridge 202. In the example of the portion of the pad of cartridge 202 that extends into the duct is configured with a set of fingers to allow air stream 212 to flow through and around cartridge 202 yet minimize restricting the flow of air through housing 230. In other examples, cartridge 202 may be implemented as a continuous sheet of material with no fingers. In other examples, cartridge 202 may be implemented as sheet with one or more holes (not shown in FIG. 2) to allow air stream 221 to pass around the material of cartridge 202. Liquid water absorbed from tray 204 and distributed through cartridge 202 may be carried by air stream 221 to rooms of the structure by distribution duct 210 and register 212.

In some examples, tray 204 is a liquid reservoir that attached to the HVAC duct of housing 230 parallel to the horizontal dimension of a slot, which is hidden from view in FIG. 2 by tray 204. The slot may be arranged such that a horizontal dimension of the slot is larger than a vertical dimension of the slot, and at a position in the HVAC duct in which air stream 221 is conveyed in a substantially vertical direction. Cartridge 202 may be inserted into the slot, such that a first portion of the pad comprising the fingers of cartridge 202 extends across an interior cross-section of the HVAC duct of housing 230.

Figure 3:
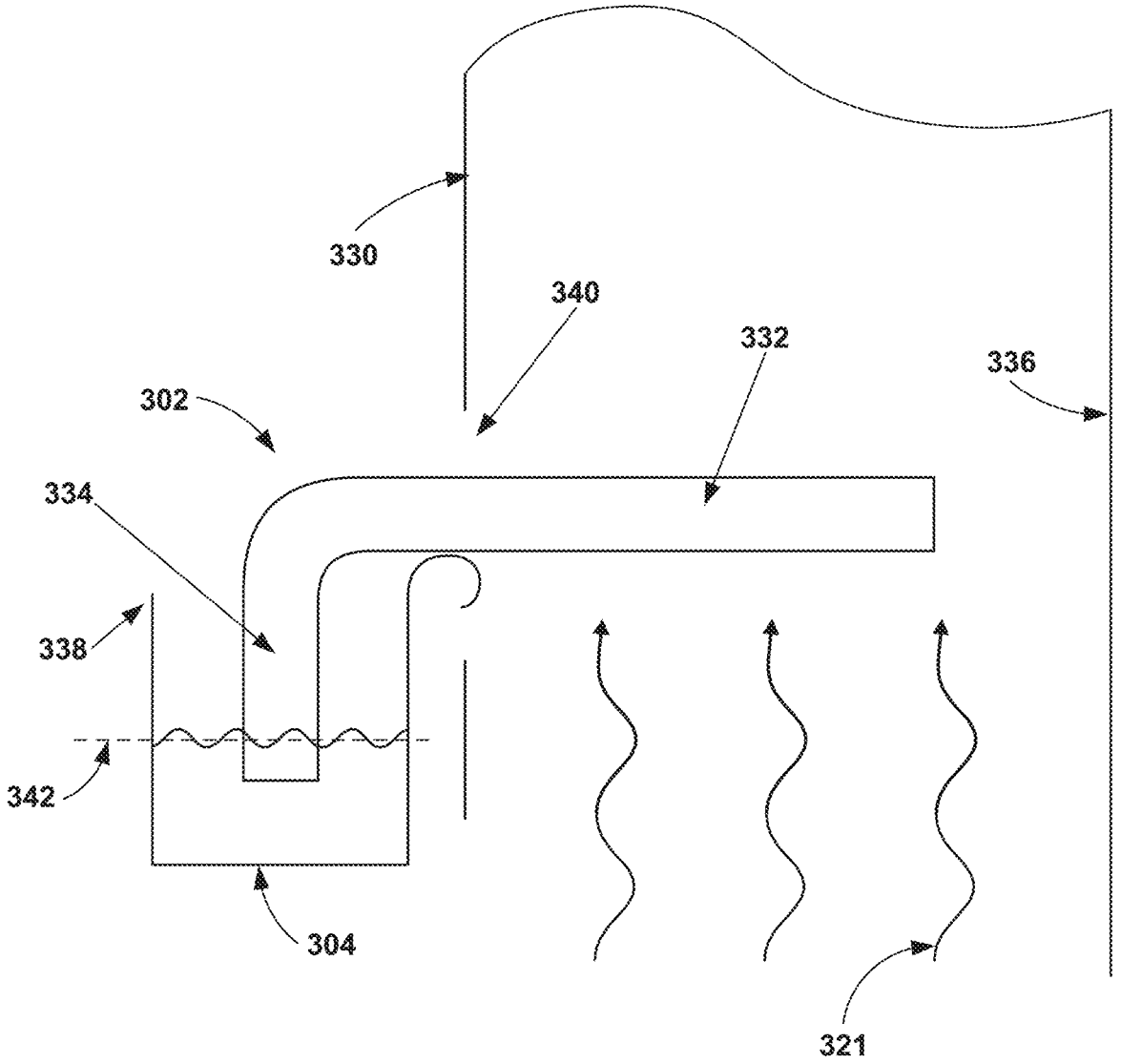
FIG. 3 is a conceptual diagram illustrating a detail view of an example evaporative humidifier according to one or more techniques of this disclosure.

FIG. 3 is a conceptual diagram illustrating a detail view of an example evaporative humidifier according to one or more techniques of this disclosure. FIG. 3 includes: housing 330 with air stream 321 and a wicking evaporative humidifier device including cartridge 302 and tray 304, which are, respectively, examples of housing 130 with air stream 121, and a wicking evaporative humidifier device that includes cartridge 102 and tray 104 described above in relation to FIG. 1. Unless otherwise described, the characteristics and functions of housing 330, air stream 321 and a wicking evaporative humidifier device including cartridge 302 and tray 304 may be similar or the same as the characteristics and functions of, respectively, housing 130, air stream 121, and a wicking evaporative humidifier device with cartridge 102 and tray 104 described above in relation to FIG. 1.

In operation, reservoir 304 holds a volume of liquid water to a predetermined level 342. Reservoir 304 may receive the first portion 334 of cartridge 302 such that the first portion 334 is maintained in contact with the liquid water. In some examples, reservoir 304 may include one or more clamps, barbs, or other retaining devices to hold cartridge 302 in place. The first portion 334 is configured to absorb liquid water from tray 304 and to wick the liquid water to the second portion 332 using capillary action.

The second portion 332 extends into the duct formed by housing 330 through slot 340. Slot 340 may have the same characteristics and function as the slot in housing 130 described above in relation to FIG. 1. The second portion 332 is configured to be positioned in air stream 321 of the forced air HVAC system, such that at least a portion of air stream 321 passes through and around the second portion 332. In some examples the second portion 332 may include one or more fingers, such as the fingers depicted in FIG. 2.

In the example of FIG. 3, the second portion 332 extends part of the way across the interior cross-section of the duct, which may allow some of air stream 321 to flow past the ends of cartridge 302. In other examples, the second portion 332 of cartridge 302 may extend all the way to the far wall 336 of the duct formed by housing 330. The second portion 332 may be mechanically connected to an inner surface of the far wall 336 of the duct opposite the wall of the duct that includes slot 340. In the example of a round duct, the second portion 332 may be shaped to fit the diameter of the far wall of the round duct. In some examples, the mechanical connection to the inner surface of far wall 336 may be implemented with one or more magnets, screws, or similar devices. The second portion 332 may be positioned perpendicular to air stream 321 or at some angle to air stream 321

In the example of FIG. 3, the second portion 332 is positioned above the first portion 334, relative to gravity and to the direction of flow of air stream 321. The first portion 334 and second portion 332 may be formed by a single pad with crimps, bends, perforations and other features to cause cartridge 302 to be shaped to fit through slot 340, retain a portion in the water reservoir of tray 304 and extend another portion into the duct. In this way, the liquid water absorbed by the first portion from tray 304 may be distributed to the second portion 332 by capillary action. The second portion 332 may then allow the liquid water to evaporate from the second portion 332 and be carried by air stream 321 away from cartridge 302.

The liquid reservoir, tray 304, may be configured to be mechanically attached to an outside surface of a wall of housing 330. Some examples of mechanical connection techniques may include screws, clips, adhesive and similar techniques. In the example of FIG. 3, tray 304 is open to the environment around housing 330. Liquid in tray 304 may evaporate from tray 304 as well as be absorbed and wicked into cartridge 302. The open example of FIG. 3 may have an advantage in allowing tray 304 and cartridge 302 to dry out when the water valve (not shown in FIG. 3) is closed. Drying when not in use may reduce the likelihood of mold formation.

In some examples the liquid reservoir, or other component of the evaporative humidifier, may include other systems to prevent mold growth, such as a UV light source. In other examples, the evaporative humidifier may include components to instill additives to the liquid reservoir. Some additives may include a mold control agent, such as household bleach. Other examples of additives may include an odor control additive, a fragrance or other types of additives.

Tray 304 of may include an overflow drain 338 implemented by ensuring the lip of 338 is lower than the part of tray 304 that connects to housing 330. In this way, liquid in tray 304 may flow out at 338 rather than into housing 330. In some examples, tray 304 may also include an overflow drain implemented by tubing, similar to overflow drain 108 described above in relation to FIG. 1.

In other examples, tray 304 may be sealed, such that the only opening is via slot 340, similar to the depiction of tray 104 in FIGS. 1 and 2. A sealed tray may have the advantage of using less water by reducing the amount of water lost to evaporation from an open tray. Using less water may be advantageous in regions in which water is more scarce or more closely monitored.

Figure 4:
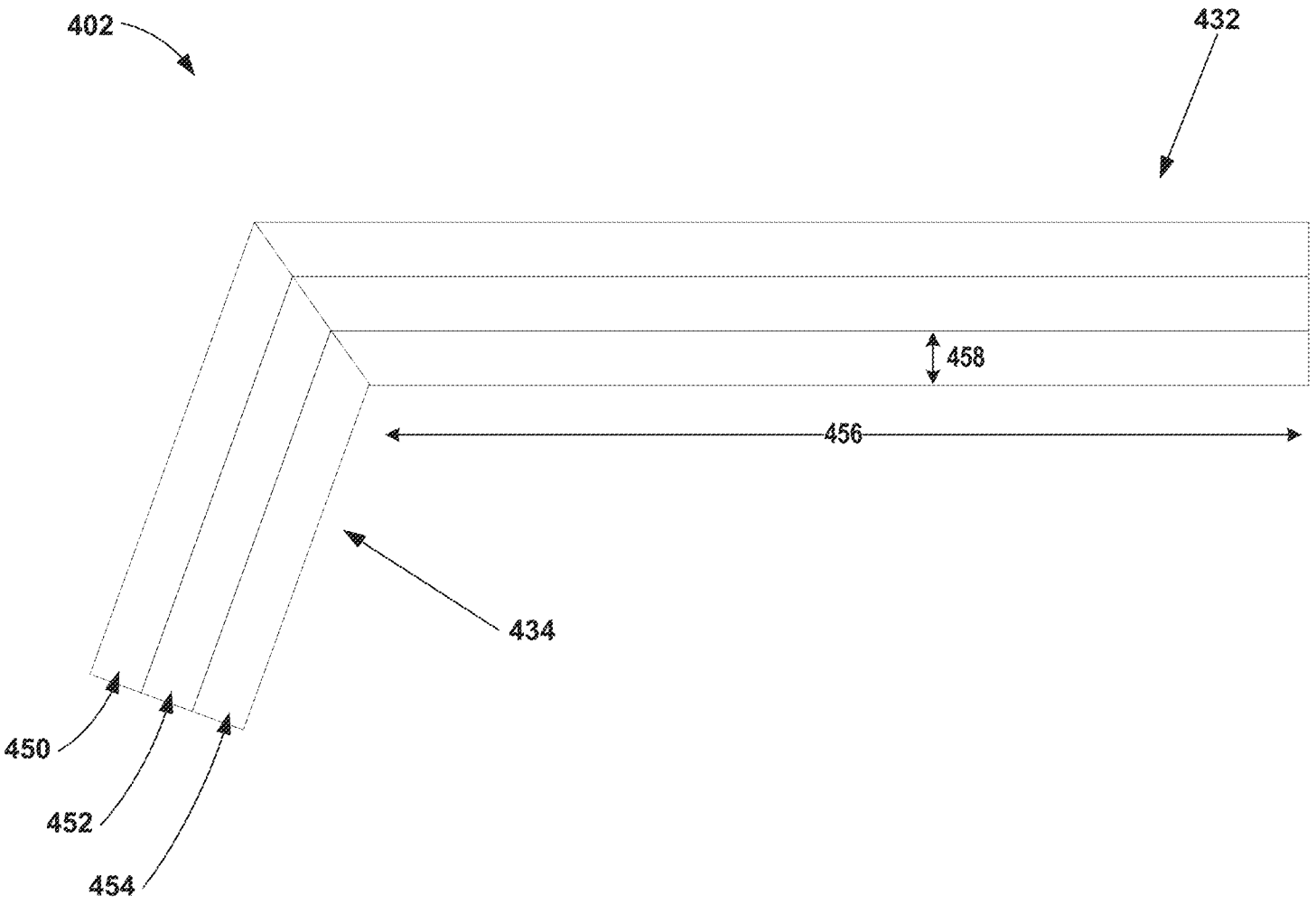
FIG. 4 is a conceptual diagram illustrating an example of layers included in the structure of the evaporative humidifier according to one or more techniques of this disclosure.

FIG. 4 is a conceptual diagram illustrating an example of layers that may be included in the structure of the evaporative humidifier according to one or more techniques of this disclosure. FIG. 4 includes a first portion 434 and second portion 432 of cartridge 402, which are, respectively, examples of the first portion 334 and the second portion 332 of cartridge 302 described above in relation to FIG. 3. Unless otherwise described, the characteristics and functions of first portion 434 and second portion 432 of cartridge 402 may be similar or the same as the characteristics and functions of, respectively, the first portion 334 and the second portion 332 of cartridge 302 described above in relation to FIG. 3.

Cartridge 402 may be implemented as a multi-layer assembly that includes one or more layers performing different functions. The example of FIG. 4 depicts 3 layers, but cartridge 402 may include any number of layers, including more than one layer of the same type.

Layer 454 in the example of FIG. 4 may be a wicking layer to absorb water from a reservoir and distribute the water throughout layer 454 by capillary action. Layer 454 may include one or more sublayers of foam, woven or non-woven fabric, microfiber, or any other material with wicking properties. The sublayers (not shown in FIG. 4) may be bonded together with a variety of techniques include adhesive, heat, vibration or other techniques. Properties used to determine wicking performance in a material may include capillary pressure and permeability. Capillary pressure is the main force responsible for the movement of moisture along or through a material, where the force of the surface tension between the liquid and the walls of a narrow gap or pore overcome the forces between the molecules of the liquid, moving it into empty gaps until the forces even out. Permeability is the measure of the ability of a material to transport moisture through the material. In some examples, permeability is determined by a combination of sizes of spaces within the material and the connections between the spaces. In the example of a fabric, other properties that may affect the wicking properties of the fabric include yarn twist, contact angle (between the fiber and the liquid), knit or weave, yarn roughness and other properties. Wicking layer 454 may be described as configured to facilitate liquid water flow or movement parallel to a long dimension 456 of layer 454 and perpendicular to a short dimension 458 of layer 454.

Layer 450 may act as a structural support for cartridge 402. The structural support of layer 450 may provide support to maintain the shape of cartridge 402 when a circulation blower forces an air stream through and around cartridge 402. The structural support of layer 450 may be implemented as a network of metallic wires, a plastic mesh or similar rigid or partially rigid material. In some examples structural layer 450 may be arranged such that structural layer 450 is downstream of the wicking layer 454, relative to the air stream. In this manner structural layer 450 may resist the force applied to cartridge 402 similar to the manner in which an HVAC air filter is configured, such as filter 116 described above in relation to FIG. 1. Layer 452 may be a bonding layer such as an adhesive or similar material to bond structural layer 450 to wicking layer 454.

Figure 5:
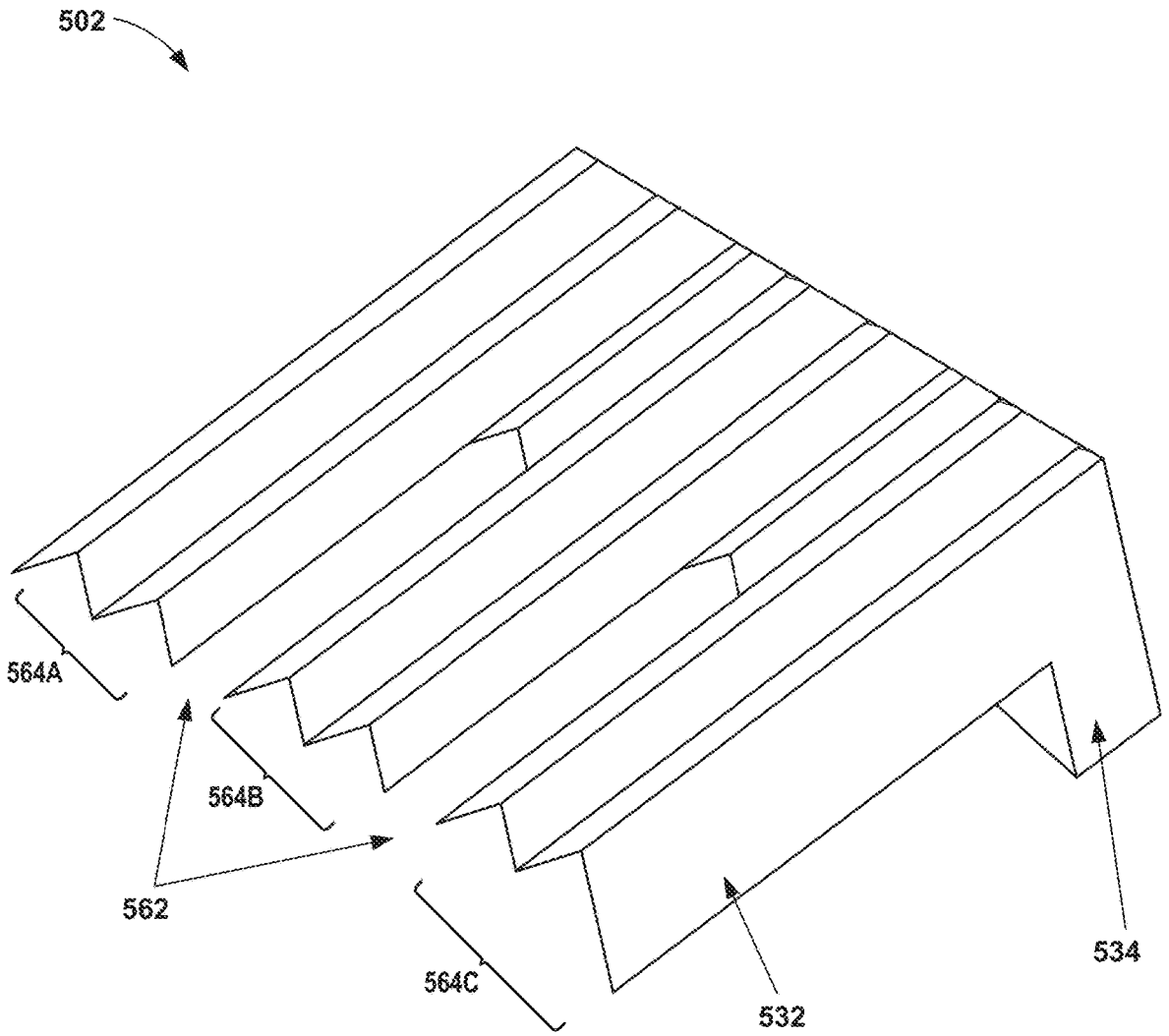
FIG. 5 is a conceptual diagram illustrating an example of the cartridge of this disclosure configured with pleats.

FIG. 5 is a conceptual diagram illustrating an example of the cartridge of this disclosure configured with pleats. FIG. 5 includes a first portion 534 and second portion 532 of cartridge 502, which are, respectively, examples of the first portion 334 and the second portion 332 of cartridge 302 described above in relation to FIG. 3. Unless otherwise described, the characteristics and functions of first portion 534 and second portion 532 of cartridge 502 may be similar or the same as the characteristics and functions of, respectively, the first portion 334 and the second portion 332 of cartridge 302 described above in relation to FIG. 3. Cartridge 502 may be implemented as a multi-layer assembly as described above in relation to FIG. 4.

Cartridge 502 also depicts fingers 564A-564C, which define spaces 562 between the fingers. The material of fingers 564A-564C, and other areas of second portion 532 may be implemented in a pleated shape. In other examples, not shown in FIG. 5, the pleated shape of cartridge 502 may be implemented as a continuous pad with no fingers and no spaces 562.

A pleated shape may provide additional surface area as well a structural support to retain the shape of cartridge 502. A pleated shape may also allow cartridge 502 to be folded into a smaller package for storage or transport.

An air stream, such as air stream 121, output from a circulation blower, such as fan 118, may pass through an around cartridge 502 as described above in relation to FIG. 1. At least a portion of the air stream from the circulation blower may pass through the one or more layers of material of the second portion 532 of the pad of cartridge 502. The air stream may also pass around cartridge 502, such as through spaces 562. Liquid from a reservoir, such as tray 104 described above in relation to FIG. 1, may be absorbed by the first portion 534 and distributed by capillary action. The liquid water may evaporate from the second portion 532 and be carried by the air stream away from cartridge 502.

Figure 6A:
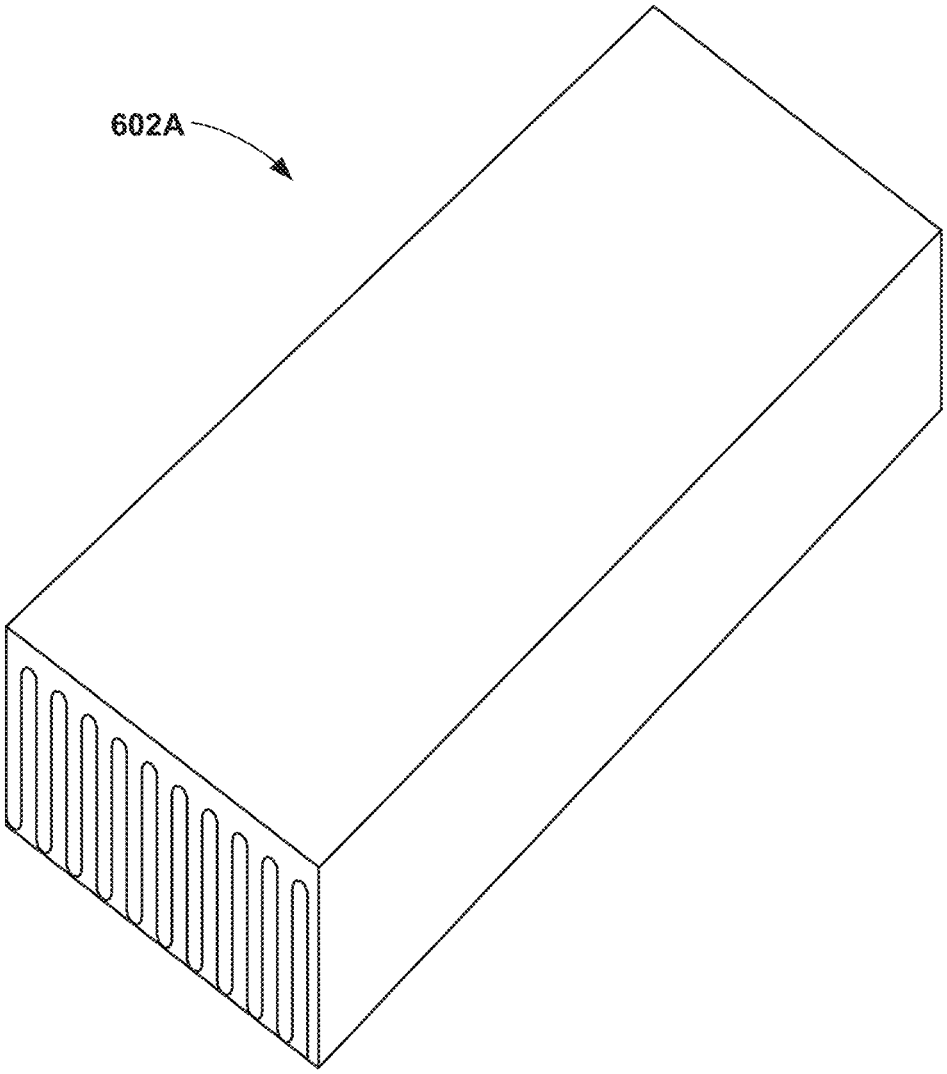
FIGS. 6A and 6B are a conceptual diagram of the cartridge of this disclosure in a packaged form.
Figure 6B:
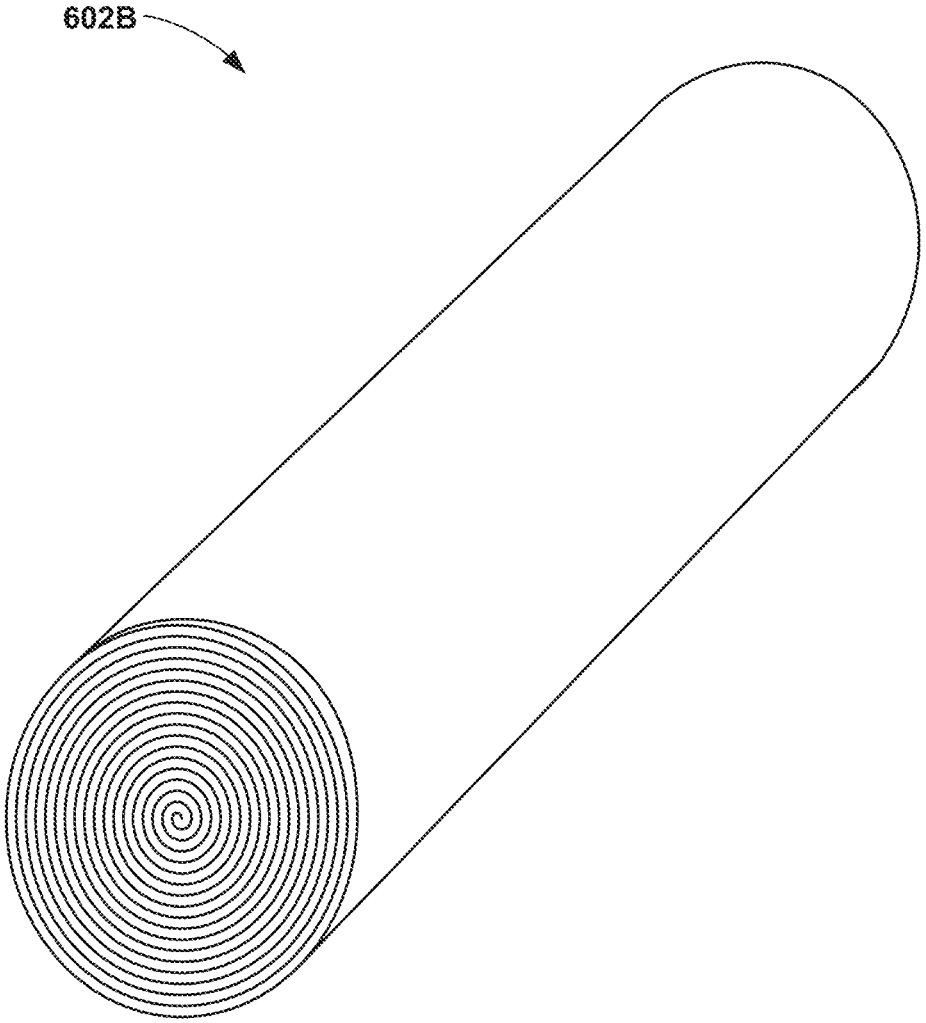

FIGS. 6A and 6B are a conceptual diagrams of the cartridge of this disclosure in a packaged form. Cartridges 602A and 602B are examples of cartridges 102 and 502 described above in relation to FIGS. 1 and 5.

In the example of FIG. 6A, cartridge 602A is folded into a compact rectangular package that may be used for storage or transport. In the example of FIG. 6B, cartridge 602B is rolled into a compact cylindrical package. The pleated shape depicted by cartridge 502 in FIG. 4 may be packaged as either the rectangular or cylindrical shapes depicted by either FIG. 6A or 6B. In some examples, cartridges 602A and 602B may occupy a larger volume when installed at the position in the HVAC duct, similar to that depicted in FIGS. 1-5. When folded into a rectangular, cylindrical or other packages shape, cartridges 602A and 602B may occupy a much smaller volume, such as less than one-half to one-third the of the volume occupied when installed in an HVAC duct.

The compact package may provide advantages over other examples of evaporative humidifier pads. For example, a compact size used for storage or transport may take up less space than other examples of humidifier pads. Taking up less space, for example on a delivery vehicle, may allow a service technician to carry additional stock of cartridges, as well as additional tools and parts than would be possible with a larger sized humidifier pad package. The compact package may also require less packaging material, such as for a cardboard storage container, and may also be sturdier to provide protection from damage during storage or transport.

Various examples of the disclosure have been described. These and other examples are within the scope of the following claims.

The invention claimed is:

1. A device comprising:

a cartridge comprising a first portion and a second portion, wherein:

the first portion is configured to absorb liquid water and wick the liquid water to the second portion;

the second portion is configured to:

be positioned in an air stream of a forced air heating ventilation and air conditioning (HVAC) system such that at least a portion of the air stream passes through the second portion of the cartridge, received and distribute the liquid water from the first portion by capillary action;

allow the liquid water to evaporate from the second portion and be carried by the air stream away from the cartridge;

a reservoir configured to:

be mechanically attached to an outside surface of a wall of a duct containing the air stream of the HVAC system;

hold a volume of liquid water; and receive the first portion of the cartridge such that the first portion is maintained in contact with the liquid water.

2. The device of claim 1, wherein the reservoir is partially open to air outside of the duct.

3. The device of claim 1, further comprising an over flow drain configured to prevent liquid water from flowing into the duct.

4. The device of claim 1, further comprising an inlet configured to receive liquid water.

5. The device of claim 1, further comprising a water level sensor configured to output a signal when a level of water in the reservoir drops below a predetermined water level.

6. The device of claim 5, wherein the water level sensor is a float valve.

7. The device of claim 1, wherein the wall of the duct is a first wall and wherein the second portion is configured to be mechanically connected to an inner surface of a second wall of the duct opposite to the first wall.

8. The device of claim 7 wherein the mechanical connection to the inner surface of the second wall comprises one or more magnets mechanically attached to the second portion.

9. The device of claim 8, wherein the second portion is further configured to be positioned above the first portion, relative to gravity.

10. The device of claim 1, wherein the second portion of the cartridge is configured to fit in a slot in a duct containing the air stream of the HVAC system, wherein:

the slot is arranged at a position in the HVAC duct in which the air stream is conveyed in a substantially vertical direction, and the slot is arranged such that a horizontal dimension of the slot is larger than a vertical dimension of the slot.

11. The device of claim 10, wherein the first portion and the second portion are configured to occupy a first volume when installed at the position in the HVAC duct and configured to be folded up when in storage and transport into a package occupying a second volume less than one-third the of the first volume.

12. The device of claim 1, wherein the cartridge further comprises:

a first layer configured to facilitate liquid water flow parallel to a long dimension of the first layer and perpendicular to a short dimension of the first layer;

a second layer configured to provide structural support to pad;

a third layer configured to bond the first layer to the second layer.

13. The device of claim 12, wherein the second layer is downstream of the first layer, relative to the air stream.

14. The device of claim 1, wherein the second portion comprises one or more fingers and one or more spaces between each of the one or more fingers, wherein air stream through the one or more spaces between the fingers is not in contact with liquid water present in the one or more fingers.

15. A system comprising:

a heating, ventilation and air conditioning (HVAC) duct configured to convey air to an inside space of a structure;

wherein the HVAC duct is arranged between an output of a circulation blower and a register configured to deliver an air stream from the circulation blower to the inside space of the structure, wherein the HVAC duct comprises a slot, wherein the slot is arranged at a position in the HVAC duct in which the air stream is conveyed in a substantially vertical direction, and the slot is arranged such that a horizontal dimension of the slot is larger than a vertical dimension of the slot;

a liquid reservoir attached to the HVAC duct parallel to the horizontal dimension of the slot; and a pad inserted into the slot, such that a first portion of the pad extends across an interior cross-section of the HVAC duct and wherein:

at least a portion of the air stream from the circulation blower passes through the first portion of the pad, and a second portion of the pad is inserted into the liquid reservoir such that the second portion of the pad is configured to wick a liquid from the liquid reservoir to the first portion of the pad.

16. The system of claim 15, further comprising:

control electronics;

a sensor, operatively coupled to the control electronics, wherein the sensor is configured to determine one or more environmental conditions of the inside space;

a water control valve operatively coupled to the control electronics; and a water level sensor operatively coupled to the control electronics and configured to determine the water level in the liquid reservoir;

wherein the control electronics is configured to:

in response to determining that a humidity level of the inside space should be increased, based on a signal from the sensor, activate the water control valve to cause liquid water to enter the liquid reservoir; and deactivate the water control valve to prevent water from entering the liquid reservoir in response to determining that either:

the humidity level of the inside space should not be increased, or the water level in the liquid reservoir exceeds a water level threshold.

17. The system of claim 15, wherein the HVAC duct comprises a first wall and a second wall, wherein the slot is on the first wall, and wherein the second portion is configured to be mechanically connected to an inner surface of the second wall of the duct opposite to the first wall.

18. The system of claim 15, wherein the reservoir is open to air outside of the duct.

19. The system of claim 16, wherein the first portion and the second portion are configured to occupy a first volume when installed at the position in the HVAC duct and configured to be folded up when in storage and transport into a package occupying a second volume less than one-third the of the first volume.

* * * * *